United States Patent [19]

O'Neill

[11] 4,100,690

[45] Jul. 18, 1978

[54] FOLDED COMPOSITE STRUCTURE

[76] Inventor: John Edward O'Neill, Teal House, 34 Broad St., Penryn, Cornwall, England

[21] Appl. No.: 748,291

[22] Filed: Dec. 7, 1976

[30] Foreign Application Priority Data

Dec. 10, 1975 [GB] United Kingdom ..... 50554/75

[51] Int. Cl.[2] ..... G09F 1/12

[52] U.S. Cl. ..... 40/154

[58] Field of Search ..... 40/154, 155, 152, 124.1; 248/459

[56] References Cited

U.S. PATENT DOCUMENTS

| | | | |
|---|---|---|---|
| 448,821 | 3/1891 | McBride | 40/52 |
| 1,515,338 | 11/1924 | Carter | 40/154 |
| 2,512,957 | 6/1950 | McCargo | 40/154 |
| 2,772,499 | 12/1956 | Ferrucci | 40/154 |
| 2,800,735 | 7/1957 | Sanders | 40/154 |

*Primary Examiner*—Louis G. Mancene
*Assistant Examiner*—Wenceslao J. Contreras
*Attorney, Agent, or Firm*—Cushman, Darby & Cushman

[57] ABSTRACT

A folded structure of paper, plastics, malleable metal or other foldable laminar material is formed of two or more members and is held together entirely by the interengagement of tabs and slots on the members. The positioning of the tabs and slots is such that, as well as holding the members of the structure together they define the shape of the structure having a recessed central region surrounded by a border portion having an overhanging lip serving to assist in holding in place pictures, postcards or like display material. Separators in the recessed central region can also be provided to hold postcards or the like which are smaller than the area of the central region.

9 Claims, 7 Drawing Figures

Fig.6.B.

FOLDED COMPOSITE STRUCTURE

BACKGROUND OF THE INVENTION

The present invention relates to folded composite structures and particularly to a folded structure in the form of a frame for receiving pictures, postcards, and like display material, which is simply formed from two pieces of foldable laminar material joined by a plurality of interengaged tabs and slots to form a composite structure which has a recessed central region and may have a raised and decorated border. The foldable material may be paper or card or a plastics material, or may be a plasticised or otherwise reinforced card or paper or other foldable laminar material such as malleable metal.

OBJECTS OF THE INVENTION

It is an object of the present invention to provide a folded composite structure comprising two parts held together solely by the interengagement of tabs and slots.

It is another object of the present invention to provide a composite folded structure in the form of a frame having means for supporting pictures, postcards or like display material.

It is a further object of the present invention to provide a folded display frame structure having a decorated border and a recessed central region bounded by an overhanging lip which assists in holding display material such as pictures, postcards and the like in position.

SUMMARY OF THE INVENTION

According to the present invention a folded structure in the form of a frame for receiving pictures, postcards and the like, comprises at least two members of foldable laminar material joined solely by the interengagement of a plurality of tabs and slots to form a structure with a recessed central region the sides of which have an overhanging lip, and a surroundig border.

The manner in which the members of foldable material are folded and interengaged ensures that the structure has a quite considerable stiffness and the recessed central region provides a suitable receptacle for pictures, postcards or the like which may be positioned therein. Because of the particular construction the recessed central region has an overhanging lip which acts to retain in position any pictures, postcards or like display material of an appropriate size positioned therein.

In the preferred embodiment of the invention the tabs are variously shaped so that, in addition to serving as the means for holding together the two component members of the structure, they also provide additional decoration to the border portion.

Preferably the recessed central region is formed by a first of the two members of foldable material which has a plurality of tabs projecting from the periphery thereof, which tabs are inserted through slots in the second of the two members. Although the basic construction comprises only two members, further members may be provided for additional decorative effects or structural reinforcement if desired.

In the preferred embodiment of the invention the second of the two members is provided with a first set of slots and a first set of tabs having slots therein, tabs of the said first set of tabs of said first member passing through respective slots of the said first set and through the slots of respective tabs of the said first set, the tabs of the first set of the second member being rolled over and inserted through respective slots of a second set of slots of said second member, and the tabs of the said first set of the first member being folded over and inserted through respective slots of a third set of the second member. This double interengagement of the slots and tabs of the two members ensure that they are both interengaged firmly without any risk of them becoming disengaged accidentally.

The difference in level between the raised border and the recessed central region is preferably obtained by folding a peripheral region of the first of the two members substantially through a right angle to provide an upstanding peripheral flange surrounding the main portion of this member, the said tabs of the first member then project from the periphery thereof substantially perpendicular to the general plane of the main portion of the first member.

In the preferred embodiment the slots of the second set on the second member are arranged in pairs and the tabs of the said first set pass through both slots of the associated pair, passing from one side of the second member to the other through one slot of a pair, and back to the said one side through the other slot of a pair.

Preferably the second member also has a second set of tabs which are rolled over and inserted through slots of a fourth set in the second member to define, when rolled back and tucked into their respective associated slots, a generally rectangular opening having an overhanging lip formed by the curved surfaces of the said tabs of the first and second sets. The tabs of the first and second set on the second member also serve as raised decorations for the border. The second set of tabs on the second member are also preferably shaped to provide additional decoration to the border portion of the structure. The said slots of the fourth set thereof on the second member may be arranged in pairs and respective tabs of the second set pass from one side of the second member through one slot of an associated pair, and back to the said one side through the other slot of the pair. The two slots of each pair thus separate a portion of the second member to serve as a strap under which the tabs of the second set are tucked to hold them in position. The tabs of the second set on the second member may be so positioned that they cover the free end of a plurality of the tabs on the first member where they project through slots in the said other member.

Preferably, the recessed central region is further subdivided by a plurality of separator elements, and if such are provided it is preferred that the said separator elements are strips located in slots in the said border portion of the first member so as to lie in a plane generally perpendicular to the general plane of the said first member.

Further aspects and advantages of the present invention will become apparent from a study of the following description given by way of non-restrictive example only, in which reference is made to the accompanying drawings.

BRIEF DESCRIPTION OF THE DRAWINGS

FIGS. 6A and 6B illustrate the formation of an insert lattice arrangement for subdividing the central recess of the structure to accept display material in smaller units.

DESCRIPTION OF THE PREFERRED EMBODIMENT

Figure 1:
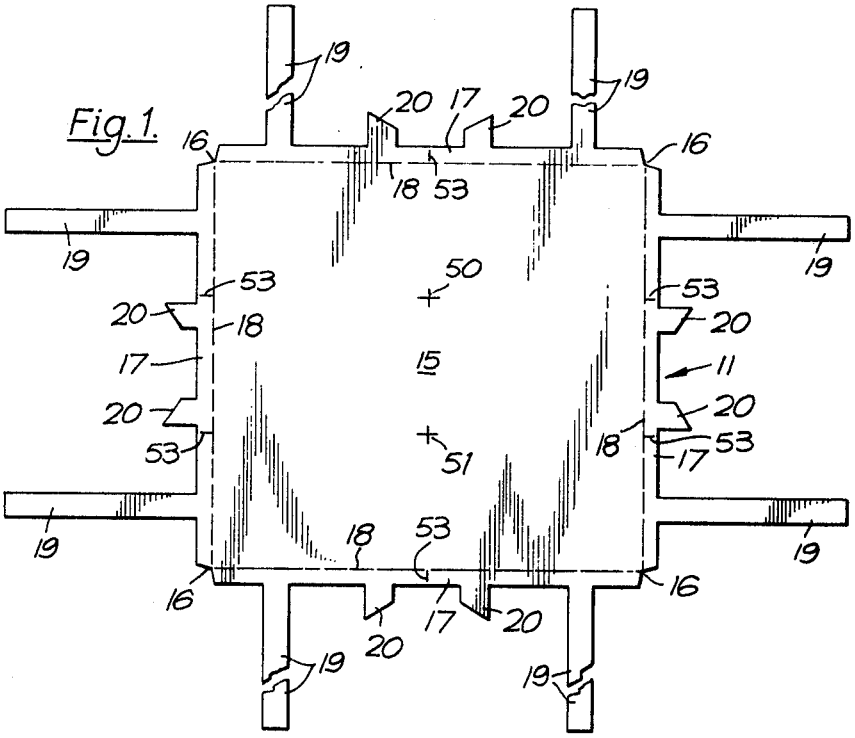
FIG. 1 is a plan view of a blank forming a first member of the structure.

Referring now to FIG. 1 there is shown a blank 11 for forming one part of the folded structure of the present invention which blank constitutes the first member of the structure, defining the recessed central region of the finished construction. The blank 11 is generally rectangular and has four notches 16, one in each corner, defining four elongate border portions 17 surrounding a central region 15 delimited by the broken lines 18. The border portions 17 are, when the device is assembled, folded through approximately 90° with respect to the central region 15 along fold lines which are coincident with the broken lines indicated 18. The border portions 17 have slots 53 therein for a purpose which will be described more fully below. Projecting from the periphery of the blank 11 are a plurality of tabs, which fall into two sets a first set 19 which are relatively long, and a second set 20 which are relatively short. The tabs 19 of the first set are positioned adjacent each corner, and the tabs 20 of the second set are spaced along the sides of the blank 11. In the central region 15 there are also two cruciform slots 50, 51, for a purpose which will be described in more detail below.

Figure 2:
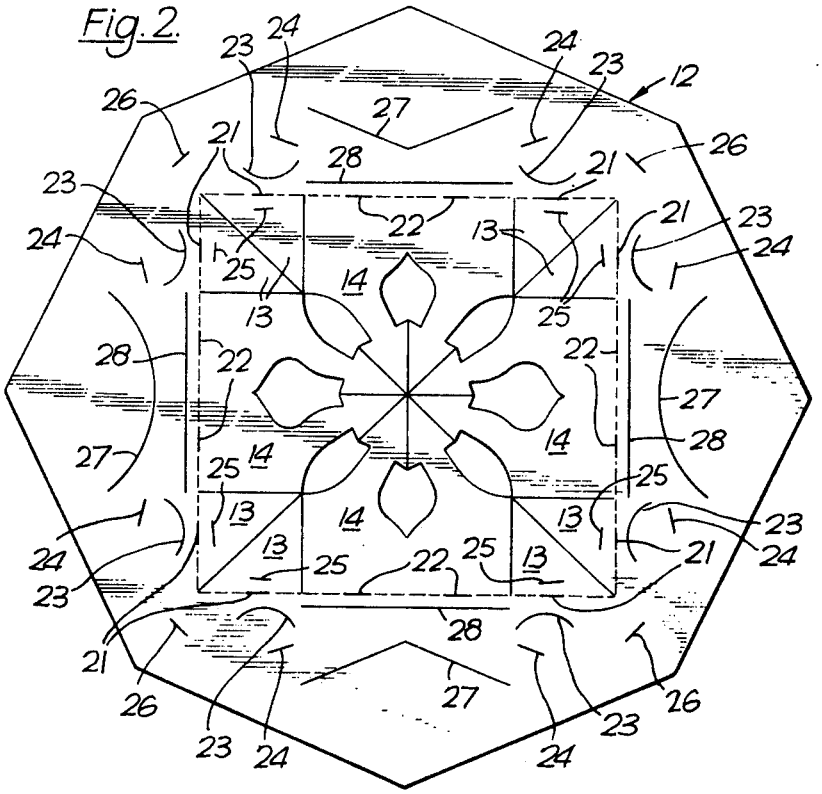
FIG. 2 is a plan view of a blank forming the second member of the structure.
Figure 3:
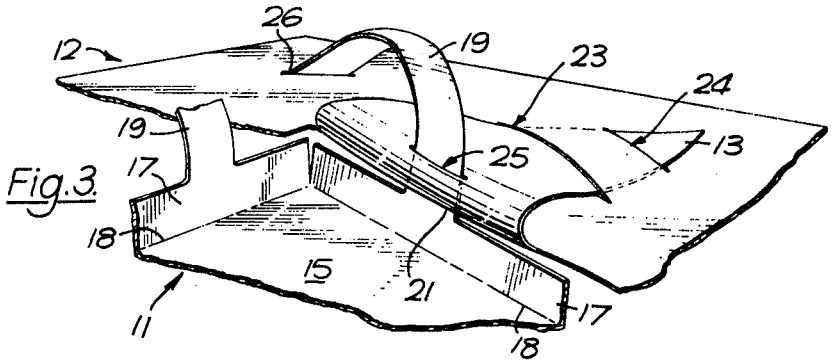
FIG. 3 is a perspective view of a part of the structure when assembled.
Figure 4:
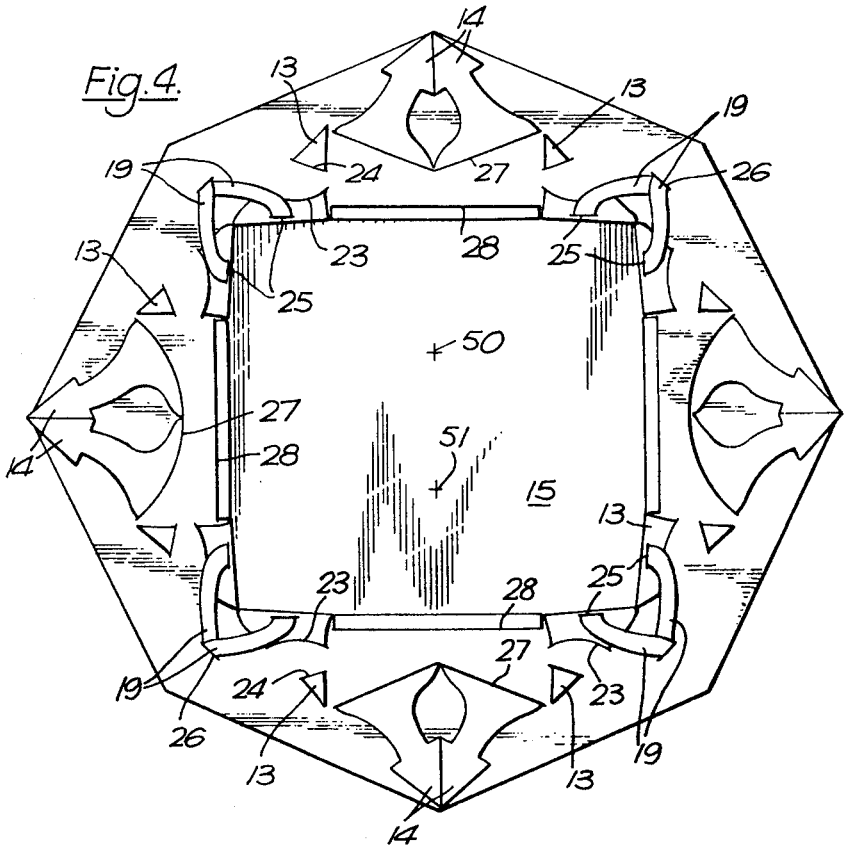
FIG. 4 is a plan view of the structure when assembled.
Figure 5:
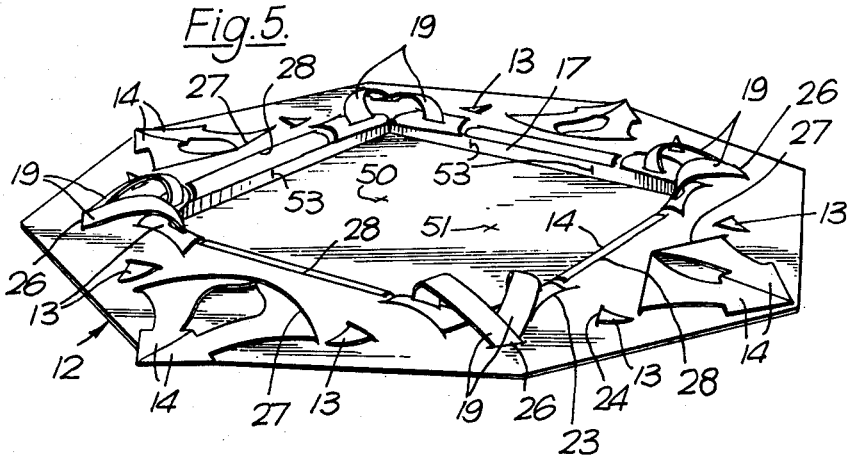
FIG. 5 is a perspective view of the structure when assembled.

Referring now to FIG. 2 the tabs 19 of the first set of the first member of the structure are inserted through respective slots 21 of a first set positioned in a rectangle in a blank 12 forming the second member of the structure. The tabs 20 of the second set of tabs on the first member are inserted through respective slots 22 spaced along the sides of the rectangle defined by the slots 21 of the first set of slots. The blank 12 forming the second member is also cut to form a plurality of triangular tabs 13 which constitute the tabs of the first set of the second member, and a plurality of shaped tabs 14 which constitute the tabs of the second set of the second member. The triangular tabs 13 of the first set are folded over and inserted through pairs of slots 23, 24 which constitute the slots of the second set in the second member. The triangular tabs 13 are inserted down through the slots 23 and then back up through the slots 24 so that they are firmly held in place. Each tab 19 of the first set of tabs of the first member 15 is inserted through a respective slot 21 of the first set of slots of the second member, and passes through slot 25 in a respective triangular tab 13. It is then folded over and inserted through a slot 26. There are four slots 26 and each receives two of the tabs 19 to provide the major part of the interengagement which holds the two parts 11 and 12 together.

Finally, the blank 12 has four pairs of relatively long slots 27, 28 arranged in pairs effectively to provide straps for holding down the shaped tabs 14 which are each rolled over and inserted down through an associated slot 28, and back up through an associated slot 27 to occupy a position such as that shown by the cross-hatching in FIG. 2. The areas shown by single-hatching in FIG. 2 are the only portions of the blank which are actually removed. All the lines marked on the blank 12 shown in FIG. 2 represent positions where the blank is cut. When the shaped tabs 14 and the triangular tabs 13 are all rolled back and inserted through their respective slots, this reveals a generally rectangular opening approximately along the lines defined by the slots 21 and 22 of the first and second sets of slots of the second member and exposes the central region 15 of the first member 11. The elongate tabs 19 of the first set on the first member 11 are twisted slightly as they are folded back so that they can be inserted in pairs through associated slots 26. The positioning and shaping of the tabs 13 and 19 provides a visual impression that the corners of the rectangular opening are slightly rounded, thereby resembling a television screen in appearance when viewed from the front.

This structure thus provides a central rectangular region 15 recessed below the level of a decorated border having rolled upstanding portions provided by the shaped tabs 14 and the triangular tabs 13 as well as the projecting and curved portions of the elongate linking tabs 19, and in the rectangular central recess region may be placed pictures, postcards or any other decorative material when the structure is hung on a wall. As will be appreciated the whole device has rectangular symmetry and may be hung by any one of the four corners at which the points of the shaped tabs 14 are located, in which case the sides of the rectangular central portion 15 will be horizontal and vertical and a pin or other fixing device used to suspend the structure can be concealed by the points of one of the shaped tabs 14. Alternatively, the structure may be suspended from any one of the other four corners, in which case the sides of the central recess region 15 will be all inclined at 45° to the vertical.

Embodiments of the present invention may be sold in kit form as two blanks marked and cut as appropriate, together with one or more pictures or sheets of display material to be mounted in the structure when assembled. Preferably the display material may take the form of a sheet of postcards, perforated so that individual postcards may be detached and posted. Because of the overhanging lip to the recess of the structure such a sheet of display material will be retained even when a number of postcards have been detached and sent.

Figure 6A:
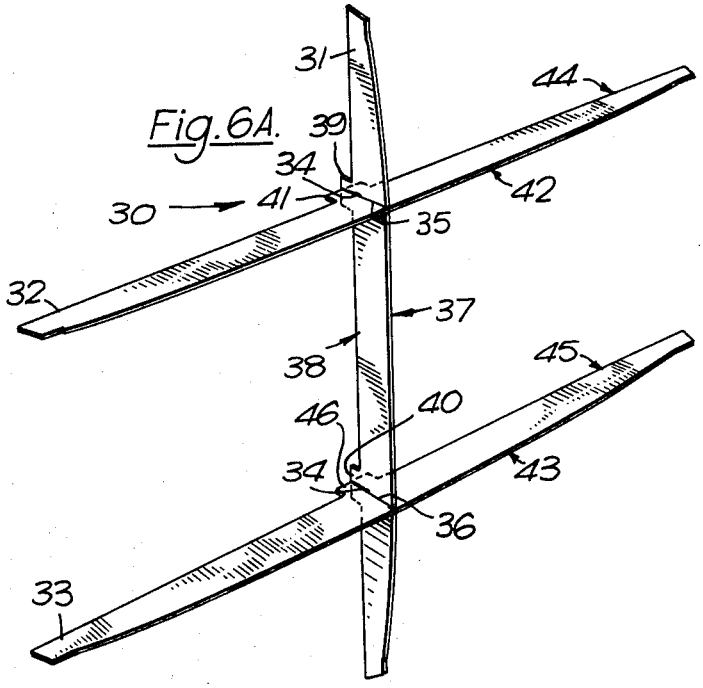
Figure 6A:
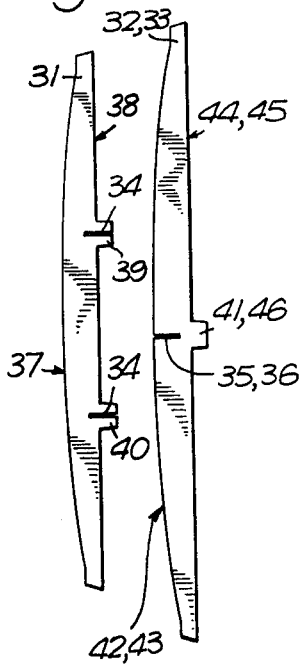

FIG. 6A illustrates a partition assembly generally indicated 30 which is provided to fit within the recess 15 to provide support for individual postcards. The partition assembly 30 is formed from three plastic strips 31, 32, 33 with respective interlocking slits 34, 35 to provide an interior lattice of vertical and horizontal supports for postcards in a structure formed as an embodiment of the present invention. FIG. 6B shows the individual plastics strips from which such a lattice may be made, in this example constituted by one vertical strip 31 and two horizontal strips 32, 33. The vertical strip 31 has a curved outer edge 37 and a substantially straight inner edge 38 with two tabs 39, 40 each located a third of the length of the strip 31 from a respective end thereof. Extending half way across the width of the strip 31 are two slits 34, 35 respectively located at the mid points of the tabs 39, 40 and extending to the edge of the tabs 39, 40 from a point mid-way across the width of the strip 31.

The two strips 32, 33 are identical and so only one is illustrated in detail. Each has an outer edge 42, 43 which is curved, and a substantially straight inner edge 44, 45. Half way along the straight inner edges 44, 45 are respective tabs 41, 46. Respective slits 35, 36 extend half way across the width of the strip 32, 33 at a point mid-way along the length thereof, from a mid point to the curved outer edge 42, 43. The lattice is assembled by inserting the strips 32, 33 into respective slits 34 of the strip 31 interengaging the slits 35, 36 thereof with the strip 31 as shown in FIG. 6A. The tabs 39, 40, 41 and 46 form cruciform projections which can be fitted into the cruciform slots 50, 51 in the central recess region 15 to assist in locating the lattice in position. The ends of the strips 31, 32, 33 fit into the slots 53 in the side walls of the central recess region 15 formed by the border portions 17 of the first member 11 of the structure.

Although a construction using only two members has been particularly described it will be apparent that embodiments of the invention can be made using more than two pieces if desired.

I claim:

1. A folded structure in the form of a frame for receiving pictures, postcards and the like, comprising:

at least first and second members of foldable laminar material, a first set of tabs projecting from the periphery of said first member, said second member being provided with:

a first set of slots, a second set of slots, a third set of slots, and a first set of tabs having slots therein, tabs of said first set of tabs of said first member passing through respective slots of said first set on said second member and through the slots of respective tabs of said first set on said second member, the tabs of said first set of said second member being rolled over and inserted through respective slots of said second set of slots of said second member, and the tabs of said first set of said first member being folded over and inserted through respective slots of said third set of slots of said second member whereby to provide a gripping effect to hold said first and second members together to form a structure with a recessed central region the sides of which have an overhanging lip, and a surrounding border.

2. A folded structure as in claim 1, wherein said slots of said second set on said second member are arranged in pairs and the tabs of said first set on said second member pass through both slots of the associated pair, passing from one side of said second member to the other through one slot of a pair, and back to said one side through the other slot of said pair.

3. A folded structure as in claim 1, wherein said second member has a second set of tabs and a fourth set of slots, tabs of said second set being rolled over and inserted through slots of said fourth set in said second member to serve as raised decorations for the border of the structure.

4. A folded structure as in claim 3, wherein said tabs on said first and second set on said second member define, when rolled back and tucked into their respective associated slots, a generally rectangular opening having an overhanging lip formed by the curved surfaces of said tabs of said first and second sets.

5. A folded structure as in claim 3, wherein said slots of said fourth set on said second member are arranged in pairs and respective tabs of said second set on said second member pass from one side of said second member through one slot of an associated pair, and back to said one side through the other slot of the pair.

6. A folded structure as in claim 1, wherein said recessed central region is further subdivided by a plurality of separator elements.

7. A folded structure as in claim 6, wherein said separator elements are strips located in slots in said border portion of said first member so as to lie in a plane generally perpendicular to the general plane of said first member.

8. A folded structure as in claim 7, wherein said separator elements have tabs at the intersection thereof located in cruciform slots in said central region of said first member.

9. A folded structure as in claim 6, wherein said separator elements are made of transparent plastics material.

* * * * *